US007527014B2

(12) United States Patent
Hey et al.

(10) Patent No.: US 7,527,014 B2
(45) Date of Patent: May 5, 2009

(54) SELF-ADJUSTING WATERCRAFT CANOPY

(75) Inventors: Kenneth E. Hey, Mercer Island, WA (US); Bryce M. Kloster, Snoqualmie, WA (US)

(73) Assignee: Sunstream Corporation, Kent, WA (US)

( * ) Notice: Subject to any disclaimer, the term of this patent is extended or adjusted under 35 U.S.C. 154(b) by 224 days.

(21) Appl. No.: 11/020,282

(22) Filed: Dec. 23, 2004

(65) Prior Publication Data

US 2005/0139141 A1 Jun. 30, 2005

Related U.S. Application Data

(60) Provisional application No. 60/532,745, filed on Dec. 29, 2003.

(51) Int. Cl.
*B63B 17/02* (2006.01)
*B63C 1/02* (2006.01)
*E04H 15/00* (2006.01)

(52) U.S. Cl. ..... 114/361; 114/44; 114/45; 114/48; 405/3; 135/87

(58) Field of Classification Search ..... 114/44–55, 114/263, 361; 405/1, 3–7; 135/87, 90
See application file for complete search history.

(56) References Cited

U.S. PATENT DOCUMENTS 3,083,540 A * 4/1963 Smith ..... 405/3
3,114,535 A * 12/1963 Burch ..... 254/127
4,018,179 A 4/1977 Rutter
4,732,102 A * 3/1988 Holman et al. ..... 114/45
5,906,264 A 5/1999 Black et al.
5,908,264 A 6/1999 Hey
6,102,059 A 8/2000 Miller
6,477,968 B2 * 11/2002 Powell ..... 114/46
6,688,252 B1 2/2004 Caravella
6,823,809 B2 11/2004 Hey
6,846,129 B1 1/2005 Edson
6,976,806 B2 12/2005 Edson
7,001,104 B2 2/2006 Edson
2005/0016438 A1 1/2005 Hey et al.

FOREIGN PATENT DOCUMENTS

GB 2324766 A * 11/1998

* cited by examiner

*Primary Examiner*—Ajay Vasudeva
(74) *Attorney, Agent, or Firm*—Davis Wright Tremaine LLP; George C. Rondeau, Jr.

(57) ABSTRACT

A self-adjusting watercraft canopy/cover assembly having a protective cover and a floating watercraft lift. The lift includes a watercraft lifting support and a float attached to the watercraft lifting support for supporting the watercraft lifting support on a body of water. The float is movable to selectively lift and lower the watercraft lifting support relative to the body of water along a first path of movement. The lift further includes an assembly which causes the protective cover to move along a second path of movement different from the first path in response to movement of the float.

11 Claims, 19 Drawing Sheets

SELF-ADJUSTING WATERCRAFT CANOPY

TECHNICAL FIELD

The invention generally relates to an apparatus and method for covering a watercraft. More particularly, it relates to a watercraft canopy/cover system that is self-adjusting in concert with the operation of a watercraft lift.

BACKGROUND OF THE INVENTION

That it is advantageous to protect watercraft from the elements by the use of watercraft canopies and/or covers and watercraft lifts is well known.

Watercraft covers and canopies protect watercraft from environmental elements and other hazards occurring above the waterline. A watercraft that is not covered may be subject to damage and degradation: Rainwater may enter the watercraft, damaging the interior and potentially overburdening the craft to the point of sinking it; ultraviolet radiation is known to cause a boat's exterior and interior surface paint and materials to degrade. Watercraft covers, generally consisting of a non-permanent synthetic fabric positioned on the top surfaces of the watercraft to conform to and cover the watercraft during non-use, avoid this difficulty by stopping rainwater, sunlight and other elements from directly contacting the surface of the boat. A difficulty inherent in existing covers, however, is that significant labor is required to remove the cover before watercraft use and to replace the cover after watercraft use. Watercraft canopies and boathouses, generally permanent or semi-permanent structures that extend above and over the watercraft without contacting the watercraft, are also used to protect moored watercraft. Watercraft canopies avoid the labor-oriented difficulties inherent in covers because they do not require removal and replacement. Unlike watercraft covers, however, canopies do not fit closely to the surface of the watercraft and elements may enter the watercraft through significant gaps between canopy and watercraft. Alternatively, a canopy may be positioned to avoid such gaps—this, however, creates the difficulty that watercraft users will not be able to easily ingress and egress the watercraft without risk of striking the canopy. Certain watercraft canopies attempt to alleviate this difficulty by providing mechanisms by which the canopy may be vertically adjusted relative to the watercraft. U.S. Pat. No. 6,688,252 B1 discloses a watercraft canopy that vertically adjusts using a wench to move canopy support members between raised and lowered positions. U.S. Pat. No. 6,102,059 employs hydraulic pressure to similarly move canopy support members vertically between raised and lowered positions. These canopies, however, are not functionally integrated with watercraft lifting devices and thus do not provide certain protections and ease of use attributes, as is further stated below.

Watercraft lifts, conversely, protect watercraft from environmental elements and other dangers generally occurring below the waterline. A watercraft may be subject to several difficulties if moored within the water: damage to the watercraft may occur when wave action or other in-water forces causes the hull of the watercraft to strike adjacent in-water structures such as docks or seawalls; damage may also result from longer term effects such as vegetative buildup on the hull of the watercraft. Watercraft lifts, such as prior art U.S. Pat. No. 6,823,809 B2, prior art U.S. Pat. No. 5,908,264, and prior art U.S. Pat. No. 4,018,179 alleviate these potential hazards by allowing the watercraft user to lift the watercraft from a position in the water to a position where the watercraft is wholly above the water. The watercraft lift thus provides a convenient solution to the before-stated difficulties since the watercraft may be quickly removed from the water during periods of non-use and returned to the water when desired with minimal user effort.

The combined use of watercraft lifts and canopies is known and such use partially addresses the foregoing difficulties. An example of one type of watercraft lift to which canopies have been attached is described in U.S. Pat. No. 5,908,264. The method of combining watercraft lift and canopy systems allows the user to employ two boat protection systems that address both watercraft hull and upper surface preservation concerns. The difficulties stated above in regard to existing canopies and covers, however, also apply to current watercraft canopy and/or cover systems. Though watercraft lifts and canopies may be used together, the current state of the art does not provide users with a mechanism that fully integrates the functional aspects of a watercraft lift with those of an adjustable canopy/cover. Users must still adjust the watercraft lift and adjustable canopy systems independently, causing difficulties in operation.

Accordingly, there is a need in the art for a watercraft canopy/cover that does not require manual removal and replacement of the canopy/cover after each use, which adjusts the canopy upwardly to provide easy watercraft ingress and egress and which is fully integrated with the operation of a watercraft lift such that the positioning of the lift in its protective, watercraft-raised position automatically causes the canopy/cover to adjust to a lowered, watercraft-protected position relative to the watercraft.

BRIEF SUMMARY OF THE INVENTION

This summary of the invention section is intended to introduce the reader to aspects of the invention and is not a complete description of the invention. Particular aspects of the invention will be pointed out in claims stated below—such claims alone will demarcate the scope of the invention.

The present invention is generally directed to an apparatus and method for covering a watercraft: More particularly, to a watercraft canopy/cover that is mechanically integrated with a watercraft lift such that the canopy/cover adjusts from an elevated first position that allows for easy passenger and watercraft ingress and egress while the lift is in its watercraft-down position to a lowered second position relative to the watercraft that substantially protects the watercraft when the watercraft lift is operated to position the watercraft in the watercraft-up position.

In one aspect of the invention, a self-adjusting watercraft canopy/cover is used with a prior art watercraft lift having a pair of approximately parallel floats that accommodate a watercraft between the floats. The floats are actuated from a first position wherein the floats are beside the watercraft and the watercraft independently floats in its position between the floats to a second position wherein the floats are beneath the watercraft and the watercraft is thereby lifted via the buoyancy of the floats beneath it. A vertically moveable lifting structure, including bunks that directly contact the watercraft, is used to support the watercraft. The canopy/cover is positioned over the watercraft lift on linkages that are attached to the watercraft lift. Upright members coupled with canopy support connections provide additional support for the canopy/cover. The canopy/cover consists of a canopy frame and a semi-flexible cover that extends over at least some part of the watercraft. The canopy/cover includes multiple linkages connecting the canopy/cover to the floats by a control element, the linkage transmitting the motion of the float between its positions to adjust the canopy/cover in such a manner that the canopy/cover is elevated when the lift is in the first position where the lifting structure upon which the watercraft is positioned is below water, and lowered when the lift is in its second position where the lifting structure upon which the watercraft is positioned is above water. The linkage may be adjustable to accommodate different watercraft heights. In another aspect of the invention, the canopy/cover may be linked to a floating or non-floating watercraft lift employing a line and a pulley connected to the canopy frame as the linkage to integrate the motion of the watercraft lift with the motion of the adjusting canopy/cover. In another aspect of the invention applying to ground-based cantilever lifts, the linkage may be pivotally attached to the cantilevering aspects of the watercraft lift by a control element consisting of an elongated extrusion at an angle whereby the outer ends of the elongated extrusion are positioned so that the control element rotates vertically upward when the cantilevering aspect of the lift rotates downward to lower the watercraft. In yet another aspect of the invention, a floating watercraft lift with floats that move vertically relative to the waterline by the displacement of air or some other lighter-than-water gas may employ canopy/cover-supporting floats as a control element that maintains the position of the canopy/cover while lowering the lifting structure, thereby allowing the canopy/cover to adjust relative to the lifting structure.

BRIEF DESCRIPTION OF THE DRAWINGS

The foregoing aspects and many of the attendant advantages of the invention will become more readily appreciated as the same becomes better understood by reference to the following detailed description, when taken in conjunction with the accompanying drawings, which are schematic, and not to scale, wherein.

DETAILED DESCRIPTION OF THE INVENTION

This section illustrates aspects of the invention, and points out certain preferred embodiments of these aspects. This section is not intended to be exhaustive, but rather to inform and teach the person of skill in the art who will come to appreciate more fully other aspects, equivalents, and possibilities presented by invention, and hence the scope of the invention is set forth in the claims, which alone limit its scope.

The present invention is generally directed to an apparatus and method for covering a watercraft: More particularly, to a watercraft canopy/cover that is mechanically integrated with a watercraft lift such that the canopy/cover adjusts from an elevated first position that allows for easy passenger and watercraft ingress and egress while the lift is in its watercraft-down position to a lowered second position relative to the watercraft that substantially protects the watercraft when the watercraft lift is operated to position the watercraft in the watercraft-up position. Several details of the preferred embodiment are set forth in the following description; FIGS. 1 through 19 provide a thorough understanding of such embodiments. One skilled in the art will understand that the present invention may be practiced without several of the details described herein. In the following description of the embodiments, it is understood that a watercraft includes any vehicle that is at least partially waterborne, which includes boats and similar vessels, but may also include amphibious vehicles including various amphibious automobiles or aircraft. Moreover, in the description that follows, it is understood that the figures related to the various embodiments are not to be interpreted as conveying any specific or relative physical dimension, and that specific or relative dimensions related to the various embodiments, if stated, are not be considered limiting unless future claims state otherwise.

Figure 1:
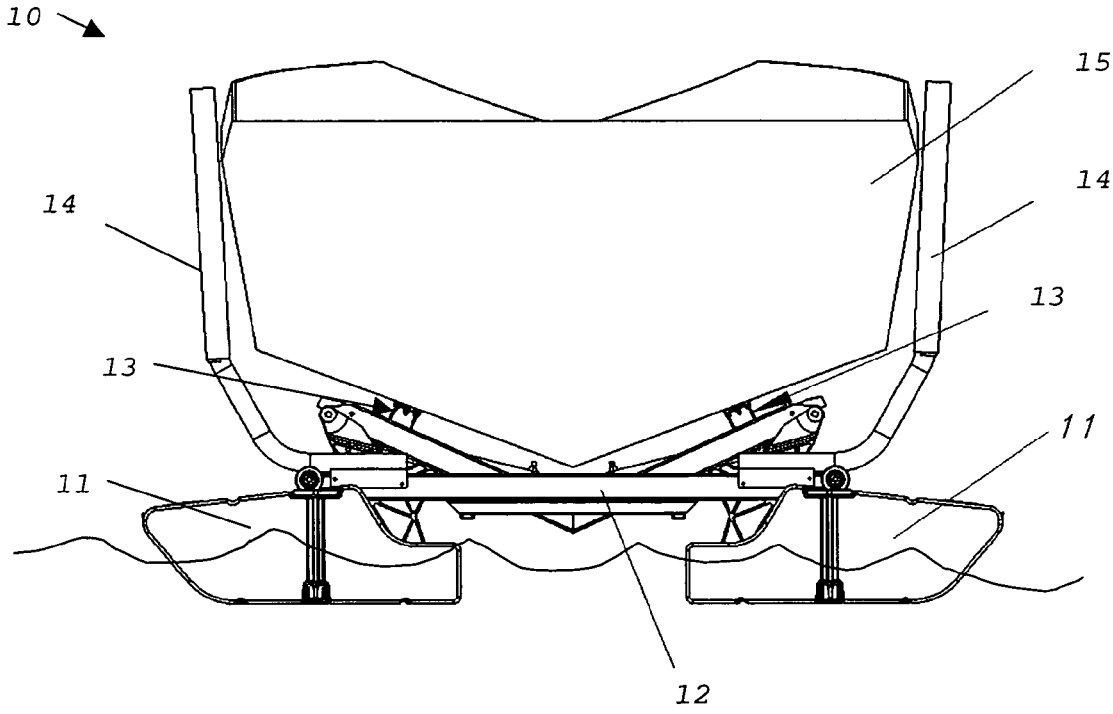
(Prior Art) Fig. 1
FIG. 1 is an end view of a watercraft lift in the watercraft up position according to the prior art.

An end view of a prior art watercraft lift to which the invention may be coupled is shown in FIG. 1. The watercraft lift 10 includes a pair of spaced apart, longitudinally extending floats 11 that are approximately parallel. The floats 11 may be comprised of a sealed and enclosed structure formed from a rigid and corrosion-resistant material, such as a rigid polymer, aluminum, or other like materials and may have a hollow interior volume to provide buoyancy when partially submerged in water. Alternatively, the floats 11 may include a material within the interior volume having a specific density less than that of water. For example, the internal volume of the floats may include a foamed polymeric material that at least partially occupies the internal volume of the floats 11. With reference still to FIG. 1, the watercraft lift 10 further includes a lifting structure 12 that is positioned between the floats 11 that is configured to receive and support a watercraft 15. The lifting structure 12 may include a pair of longitudinally extending and spaced-apart bunks 13 that define support points for the watercraft 10. The bunks 13 may be angled upwardly and inwardly as they extend from a rear portion to a forward portion of the watercraft lift 10 to additionally provide a stop mechanism for the watercraft 15 by contacting a hull portion of the watercraft 15 once the watercraft 15 is suitably positioned on the watercraft lift 10. A pair of generally upward-extending, hollow upright members 14 are also attached to the lifting structure 12. The upright members 14 present visually prominent features to an operator of the watercraft that may assist the operator in locating the lift 10 prior to positioning the watercraft in the watercraft lift 10 and may physically assist the operator in guiding the watercraft 16 into position between the floats 11. The upright members 14 also provide additional structural stability for the canopy/cover mechanism, as is discussed below.

Figure 2:
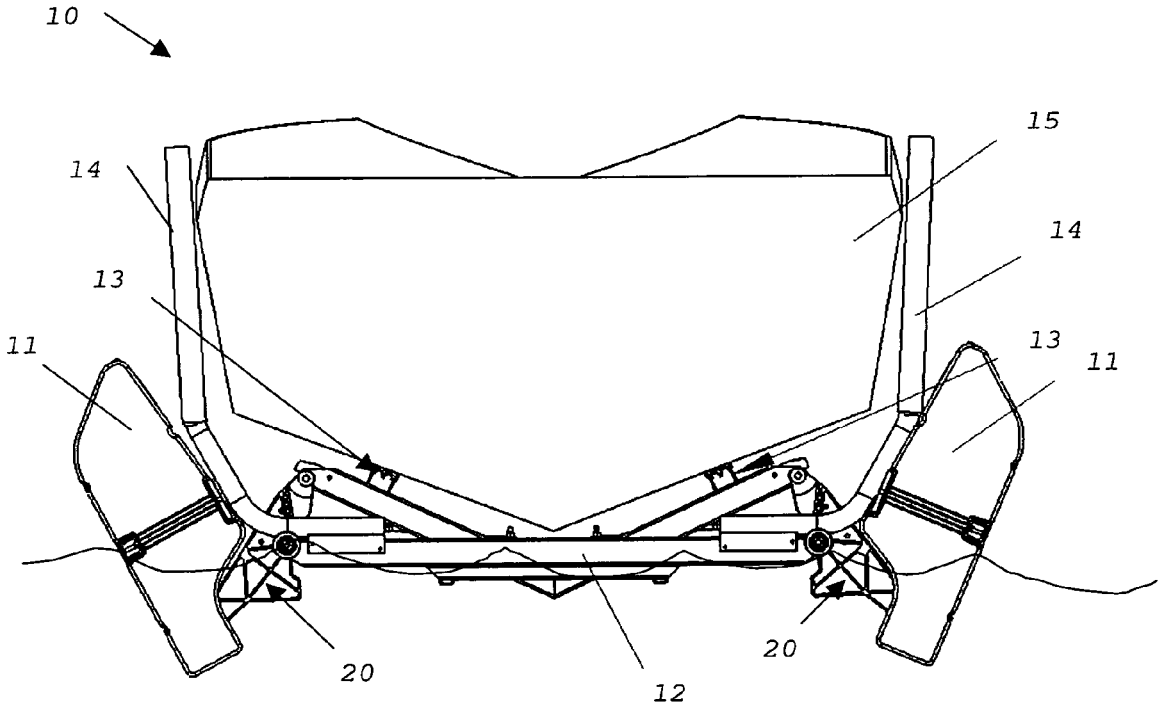
(Prior Art) Fig. 2
FIG. 2 is an end view of a watercraft lift at the approximate mid-point between the watercraft up and watercraft down positions, according to the prior art.

FIG. 2 is an end view of the prior art watercraft lift in-between the watercraft-up and watercraft-down positions. The floats 11 are actuated from a first position, shown in FIG. 1, wherein the floats 11 are underneath the watercraft 15 and the watercraft 15 is thereby lifted by the buoyancy of the floats 11 beneath it, to a second position, shown in FIG. 2, wherein lifting arms 20, pivotally connect to lifting structure 12 at one end and to floats 11 at the opposing end, are actuated to rotate outward and upward relative to the lifting structure 12, causing the floats 11 to rotate outward and upward relative to the lifting structure 12. The watercraft 15, positioned on bunks 13 which are attached to the lifting structure 12, is lowered relative to the floats and the waterline due to the upward motion and buoyancy of the floats 11.

Figure 3:
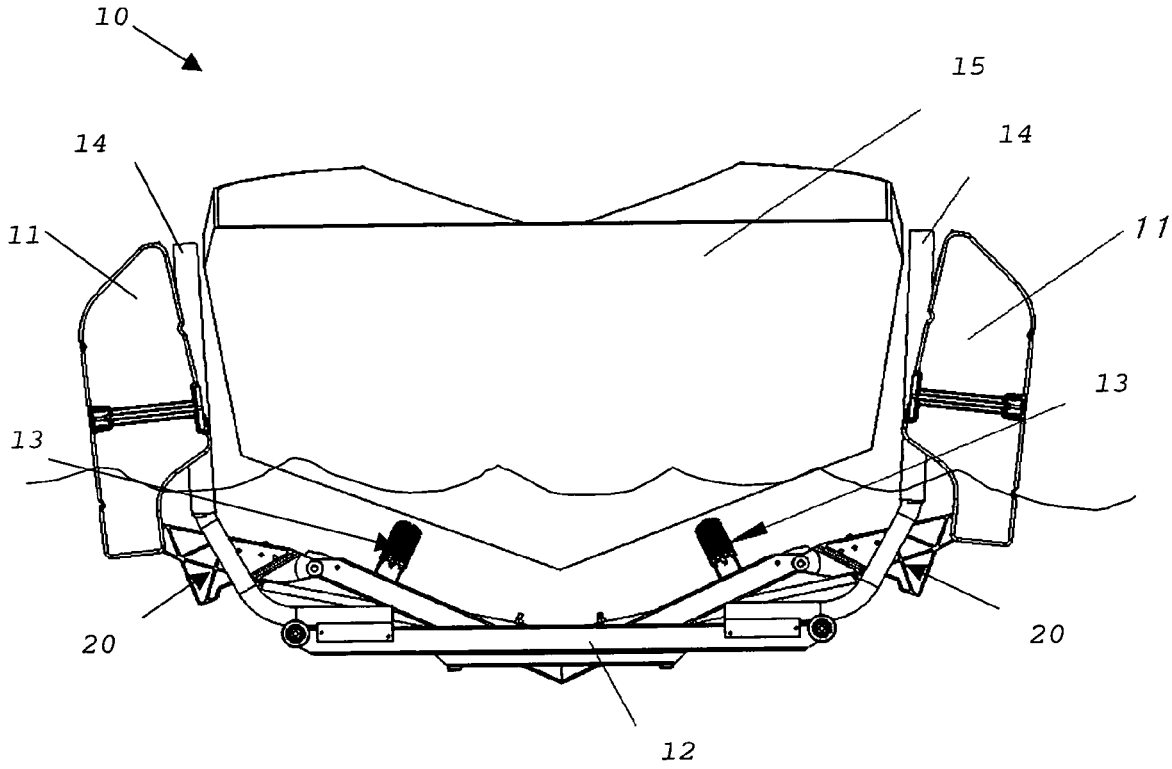
(Prior Art) Fig. 3
FIG. 3 is an end view of a watercraft lift in the watercraft down position according to the prior art.

FIG. 3 is an end view of the prior art watercraft lift 10 in the watercraft-down position. The floats are actuated from a second position, shown in FIG. 2, wherein the floats 11 are at an approximate mid-point between the watercraft-up and watercraft-down positions to a third position, shown in FIG. 3, wherein lifting arms 20 are actuated to further rotate outward and upward relative to the lifting structure 12. The watercraft 15, positioned on bunks 13 which are attached to the lifting structure 12, is further lowered relative to the floats and the waterline due to the outward and upward motion of floats 11 and lifting arms 20. At this point, the buoyancy of the watercraft 15 is sufficient to cause it to float above and independently from bunks 13 with sufficient clearance between the watercraft lift 10 and the watercraft 15 to allow easy watercraft ingress and egress.

It will be understood by one skilled in the art that the watercraft 15 is raised from the water by operating the prior art watercraft lift 10 in the opposite order of the process described above in FIGS. 1 through 3.

Figure 4:
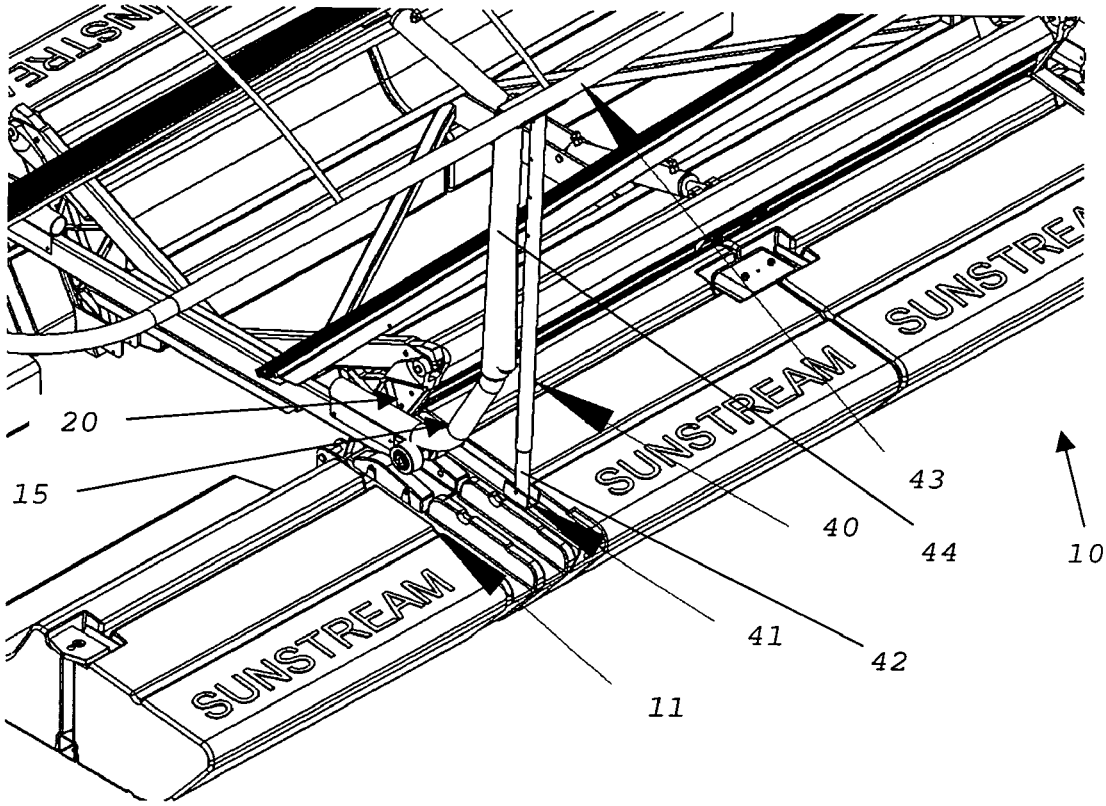
FIG. 4 is an isometric view of a portion of the prior art watercraft lift integrated with a portion of the self-adjusting canopy/cover mechanism of the present invention.

FIG. 4 is an isometric view of a portion of the prior art watercraft lift 10 integrated with a portion of the self-adjusting canopy/cover mechanism 40 of the present invention. Control element 41 consisting of a metal bracket, provides a means by which linkage 42 is attached to the prior art floats 11. Control element 41 is attached by inserting two screws (not shown) through the bracket and into the float 11. Control element 41 is positioned at the central part of prior art floats 11 such that the operating motion of the floats 11 is transferred through linkage 42 to canopy frame 43. Canopy support connection 44 is inserted into prior art upright members 15 and connected to canopy frame 43. In the preferred embodiment, four self-adjusting canopy/cover mechanisms 40 are installed on the prior art watercraft lift 10 at four points outward from and parallel to the prior art lifting arms 20 such that the canopy is stabilized above the watercraft lift 10 and provides full coverage for the subject watercraft 15 (not shown in FIG. 4).

Figure 5:
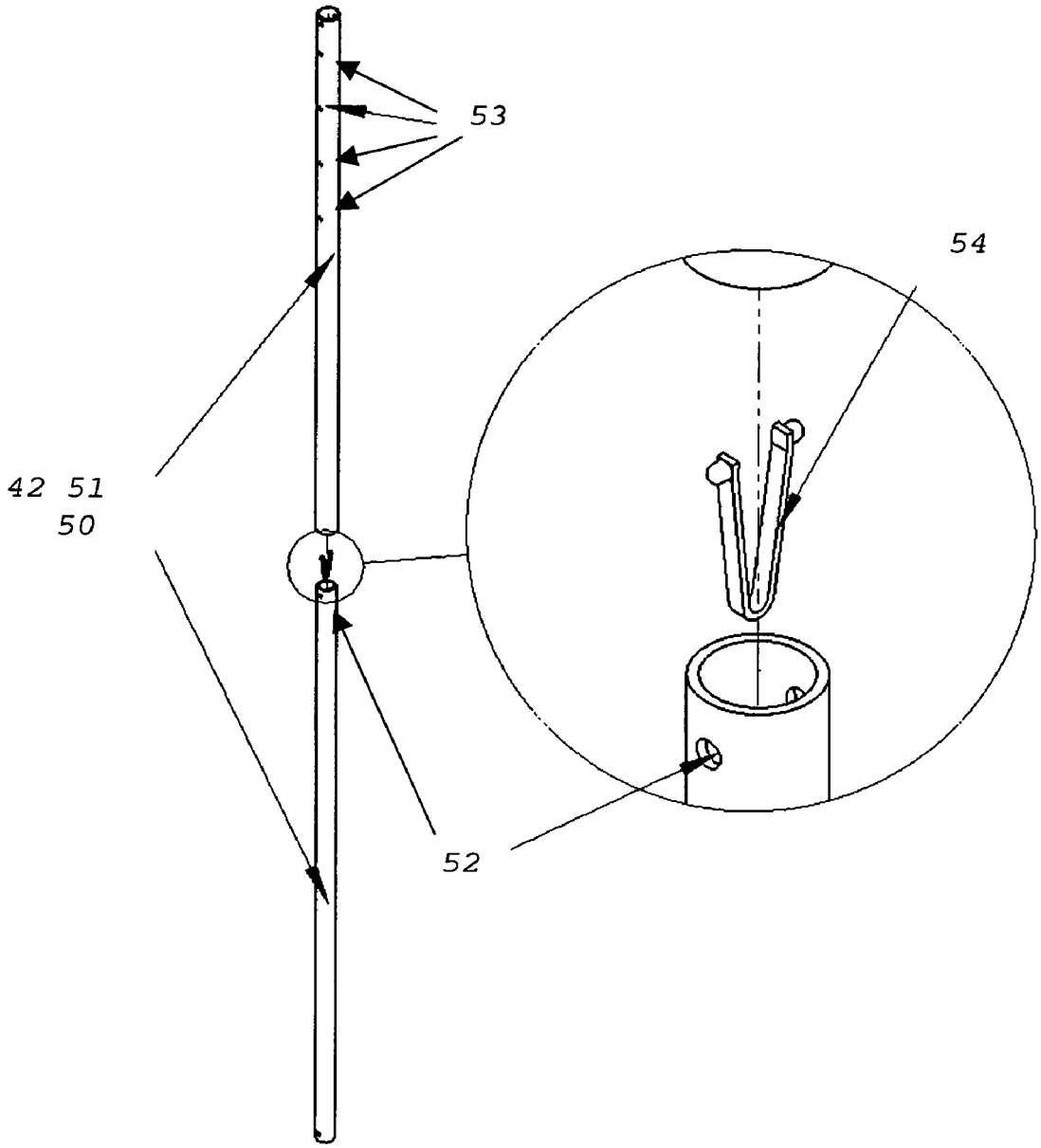
FIG. 5 is a diagrammatic view of components of the linkage of the preferred embodiment of the present invention.

FIG. 5 is a diagrammatic view of components of the linkage 42 wherein a hollow inner linkage 50, manufactured from PVC, aluminum or some other rigid material, is inserted into a hollow outer linkage 51 manufactured from a similar rigid material with a slightly larger diameter. The inner linkage 50 is drilled to include a concentric set of holes 52 at or near the top of the linkage. The outer linkage 51 is drilled to include multiple sets of concentric holes 53 spaced approximately 6 inches from each other along the vertical axis of the linkage. The concentric holes 53 may be positioned anywhere along the vertical axis of the outer linkage, according to the user's needs. A snap button 54 is inserted into the inner linkage 50 such that the snap button aligns with and penetrates through the holes 52. The inner linkage 50 is slideably inserted into the outer linkage 51 such that the snap buttons are aligned with the outer linkage's concentric holes 53 according to the canopy height requirements, which are in turn contingent upon the height of the watercraft to be covered. One skilled in the art will understand that the placement of the outer linkage's multiple holes 53 in relation to the inner linkage's holes 52 allow the user to modify the maximum and minimum heights of the canopy/cover to accommodate a full range of vessel heights, and to ensure a close fit of the canopy/cover (shown in FIG. 9) to the vessel in the watercraft-up/canopy down protected position.

Figure 6:
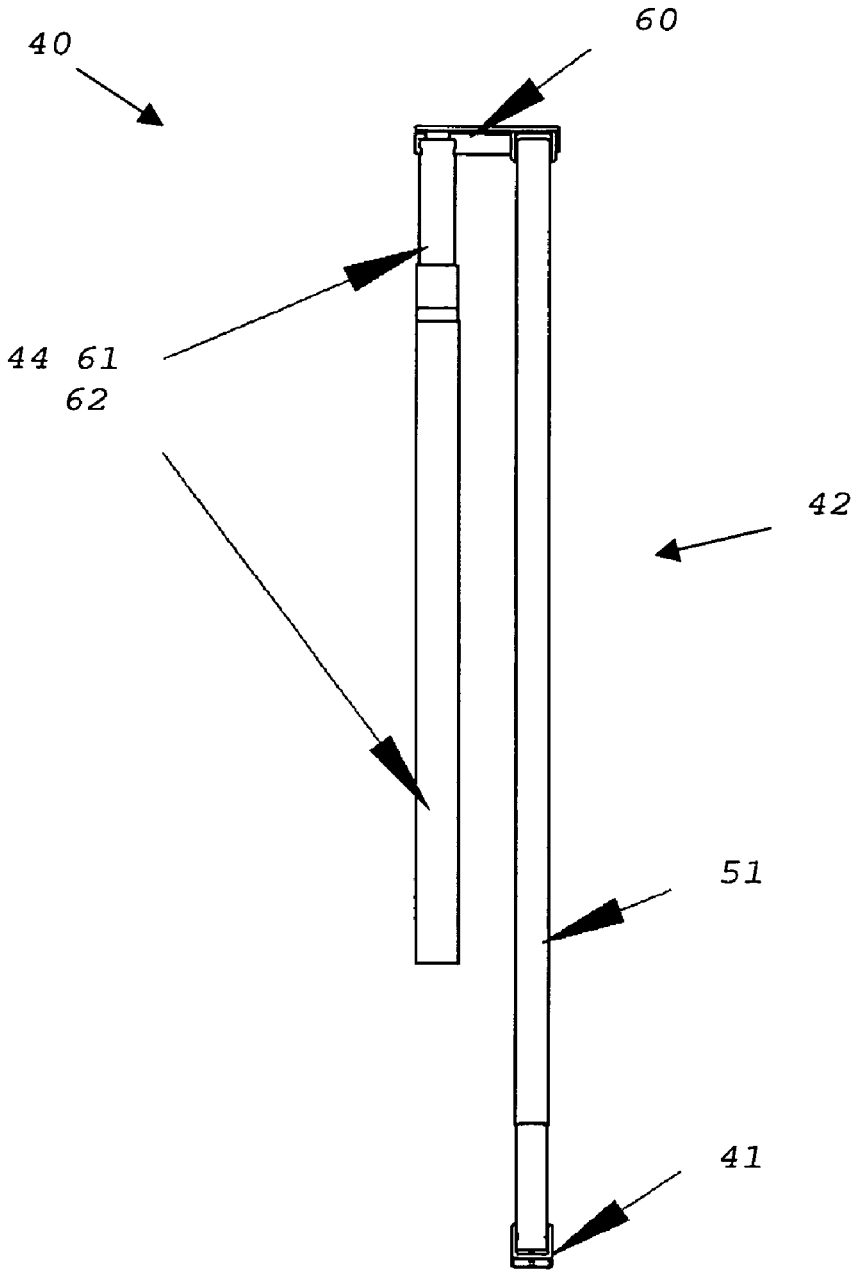
FIG. 6 is a diagrammatic view of the components of the self-adjusting canopy/cover mechanism of the preferred embodiment of the present invention.

FIG. 6 is a diagrammatic view of the components of the assembled self-adjusting canopy/cover mechanism 40. Linkage 42, canopy support connection 44, canopy frame bracket 60, and control element 41 are shown. To construct the canopy support connection 44, a hollow inner guide 61 consisting of PVC, aluminum or some other rigid material is inserted slideably into a hollow outer guide 62 consisting of the same material with a slightly wider diameter. The support connection 44 is inserted into the upright members 15 of the prior art (not shown in FIG. 6), which have a slightly larger diameter to receive the support connection; its position during operation is maintained by the rigidity of the upright members 15. The linkage 42 and canopy support connection 44 are attached to canopy frame bracket 60 by nuts and bolts (not shown). One skilled in the art will appreciate that canopy support connection 44 is not required for invention functionality, but provides additional support that may be beneficial to design performance, and that other attachment methods and configurations are possible.

Figure 7:
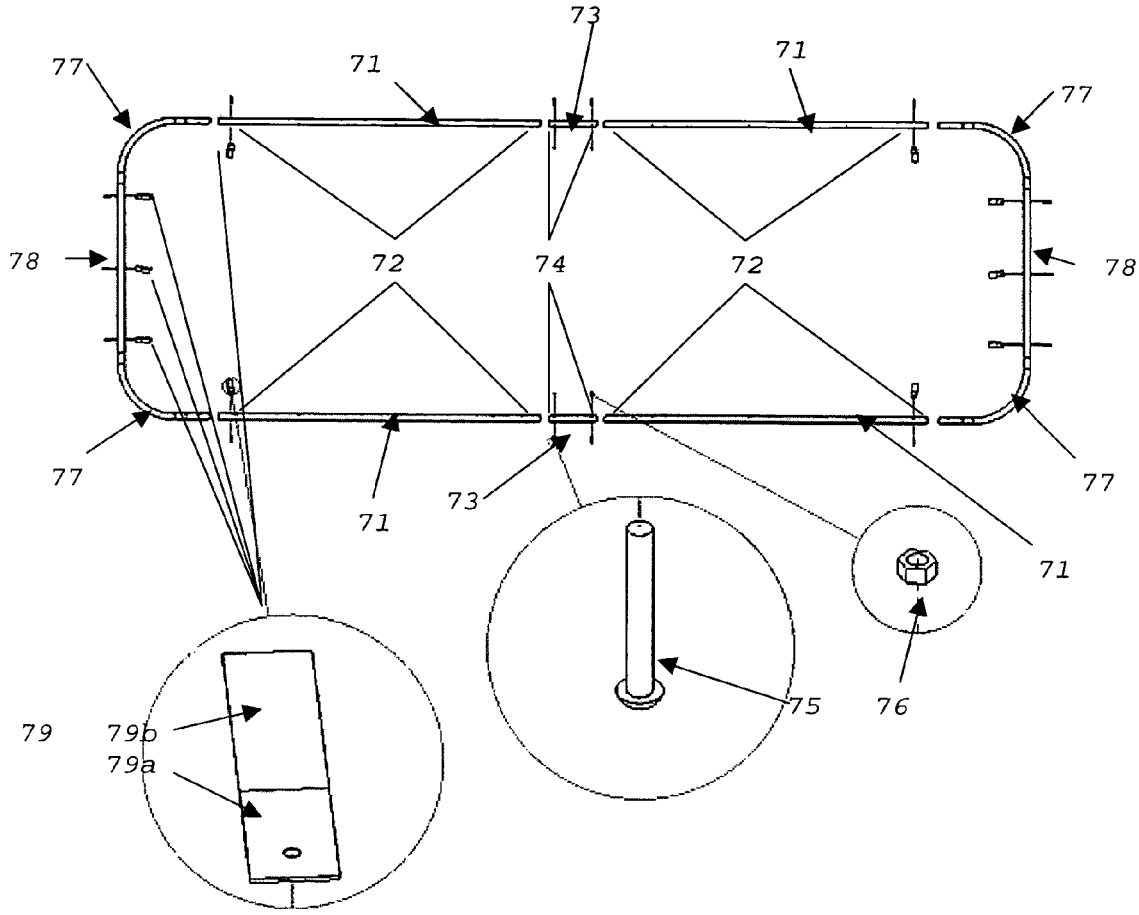
FIG. 7 is a diagrammatic view of the assembly components of the canopy frame of the present invention.

FIG. 7 is a diagrammatic view of the assembly components of canopy frame 40 of the present invention. In the preferred embodiment, hollow side tubes 71 consisting of PVC, aluminum, or some other rigid material including concentric holes 72 situated near the ends of the tubes are slideably connected to hollow central union sleeves 73 of slightly less diameter and including concentric holes 74, and secured by screws 75 and nuts 76. Hollow elbow tubes 77, also of slightly less diameter relative to side tubes 71 and including concentric holes, are attached to the outward ends of side tubes 71 using screws 75 and nuts 76. Hollow end tubes 78, consisting of PVC, aluminum, or some other rigid material including concentric holes (not shown) and having the approximate diameter of side tubes 71, are slideably attached to the ends of elbow tubes 77 and secured by screws 75 and nuts 76. Velcro straps 79 which include hooks 79*a* and loops 79*b* are situated at multiple points along the canopy frame 43. One skilled in the art will appreciate that the canopy frame 43 may be fabricated by various alternative means such as welding and that multiple materials will allow the user to obtain a relatively light-weight, rigid structure sufficient for functionality.

Figure 8:
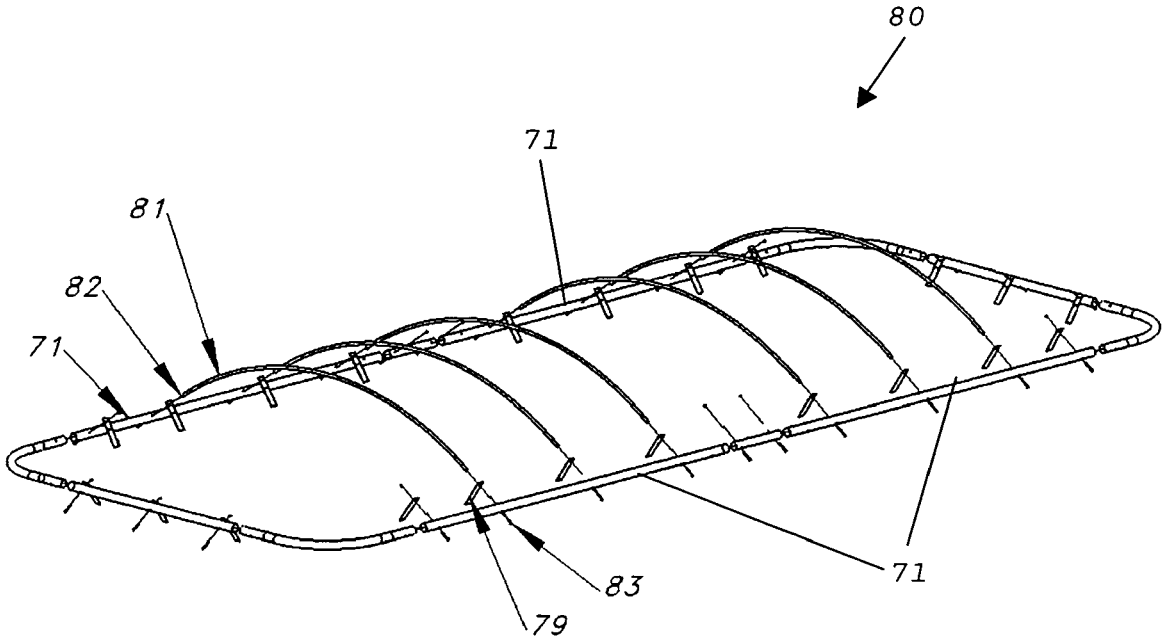
FIG. 8 is a diagrammatic view of the canopy frame and rafter system of the present invention.

FIG. 8 is a diagrammatic view of the rafter system 80 that supports the canopy/cover 91 of the present invention. Bowed rafters 81, consisting of PVC, aluminum, or some other rigid material, and having female entry points 82 at both ends, are connected to concentric points along the canopy frame's side tubes 71 to support the cover (not shown in FIG. 8). Screws 83 are driven through previously existing concentric holes in side tubes 71 and further driven through rafter female entry points to secure the rafters to the canopy frame 43. Velcro straps 79 are situated on the canopy frame 43 such that hooks 79*a* and loops 79*b* face the inside of the canopy frame 43.

Figure 9:
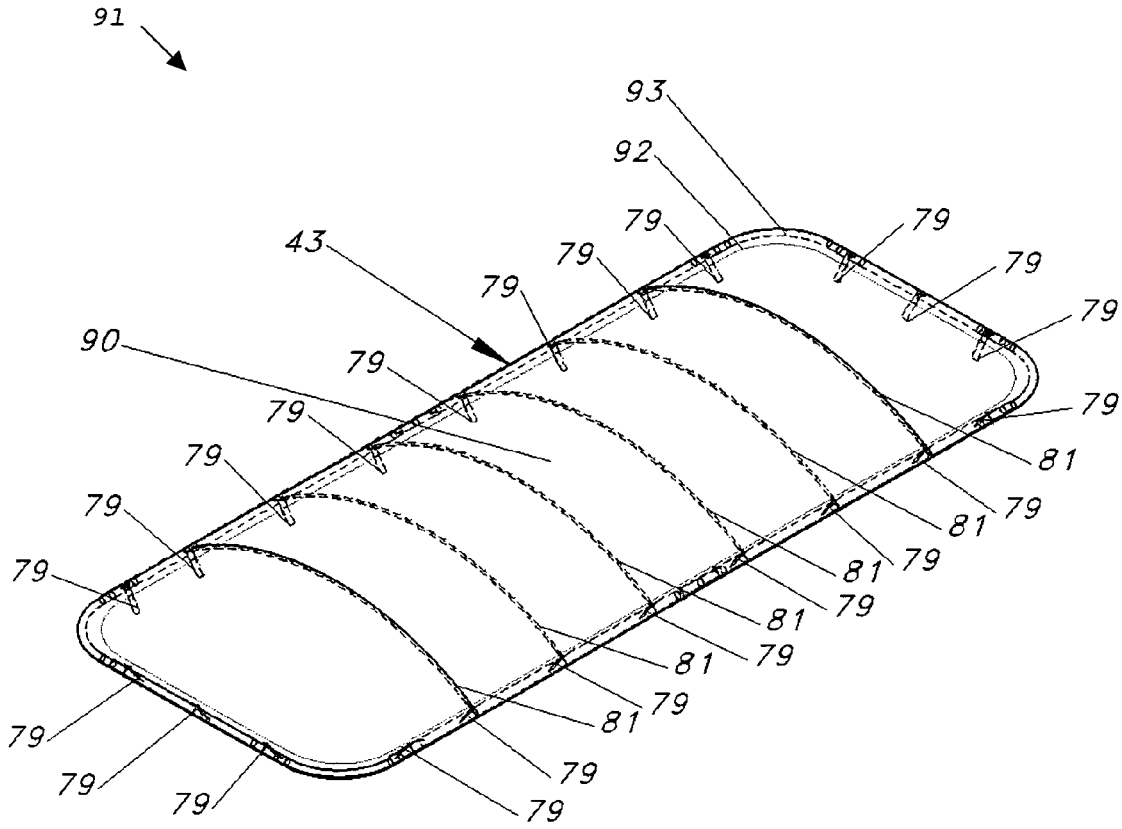
FIG. 9 is a diagrammatic view of the canopy frame and cover of the present invention.

FIG. 9 is a diagrammatic view of the canopy frame 43 and cover 90 of the present invention and the means by which the canopy frame 43 and cover 90 are attached to form the canopy/cover 91 of the invention. The cover 90, consisting of a flexible synthetic material such as laminated polyester-based fabric or some other weather-resistant flexible material and including an interior channel 92 for a draw string 93 which runs along the perimeter of the cover, is attached to the canopy frame by positioning the cover 90 above and over rafters 81. The cover 90 is made secure by pulling velcro straps 79 through pre-cut entry points along the sides of the cover 90. The cover 90 is drawn tightly over the rafters and canopy frame 43 by applying force to the velcro straps 79 and by pulling the velcro straps tight over the drawstring and then further secured by tying the opposing ends of the draw string. One skilled in the art will appreciate that flexible and non-flexible synthetic and natural materials may be used to fabricate a suitable cover 90, and that other methods of attaching the cover 90 to canopy frame 43 are available.

Figure 10:
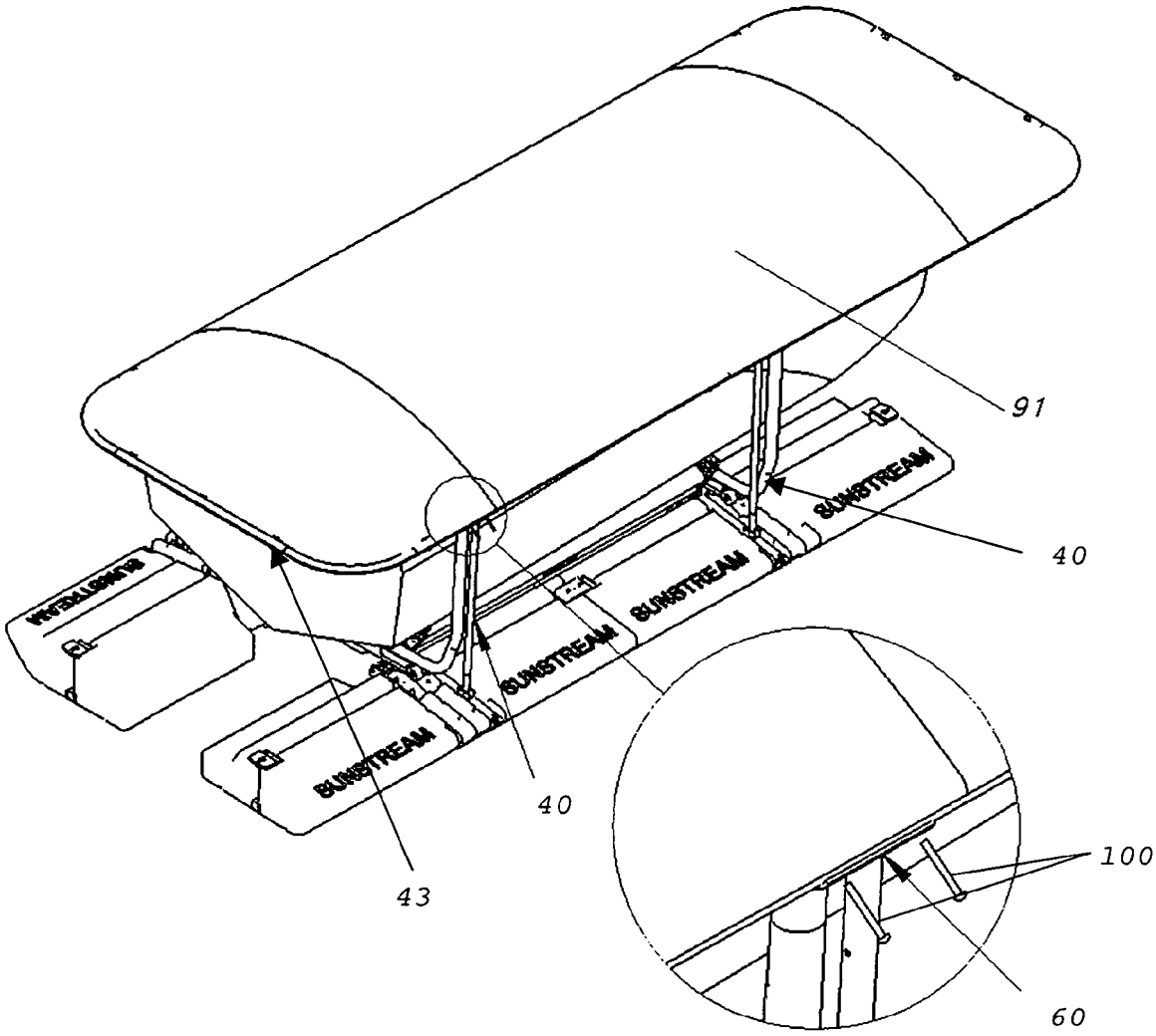
FIG. 10 is a diagrammatic view of the means by which the canopy/cover portion of the present invention is attached to the self-adjusting canopy mechanism and to the prior art watercraft lift.

FIG. 10 is a diagrammatic view of the means by which the canopy/cover portion 91 of the present invention is attached to the self-adjusting canopy mechanism 40. The canopy/cover 91 is positioned to rest within the canopy frame brackets 60 and secured to the frame brackets 60 by drilling holes into the canopy frame 43 in alignment with pre-drilled holes on the frame brackets 60. Screws 100 are inserted through the drilled holes and secured with a nut (not shown) on the opposing side of the canopy frame 43. One skilled in the art will appreciate that other attachment methods are possible and the same effect will be obtained.

Figure 11:
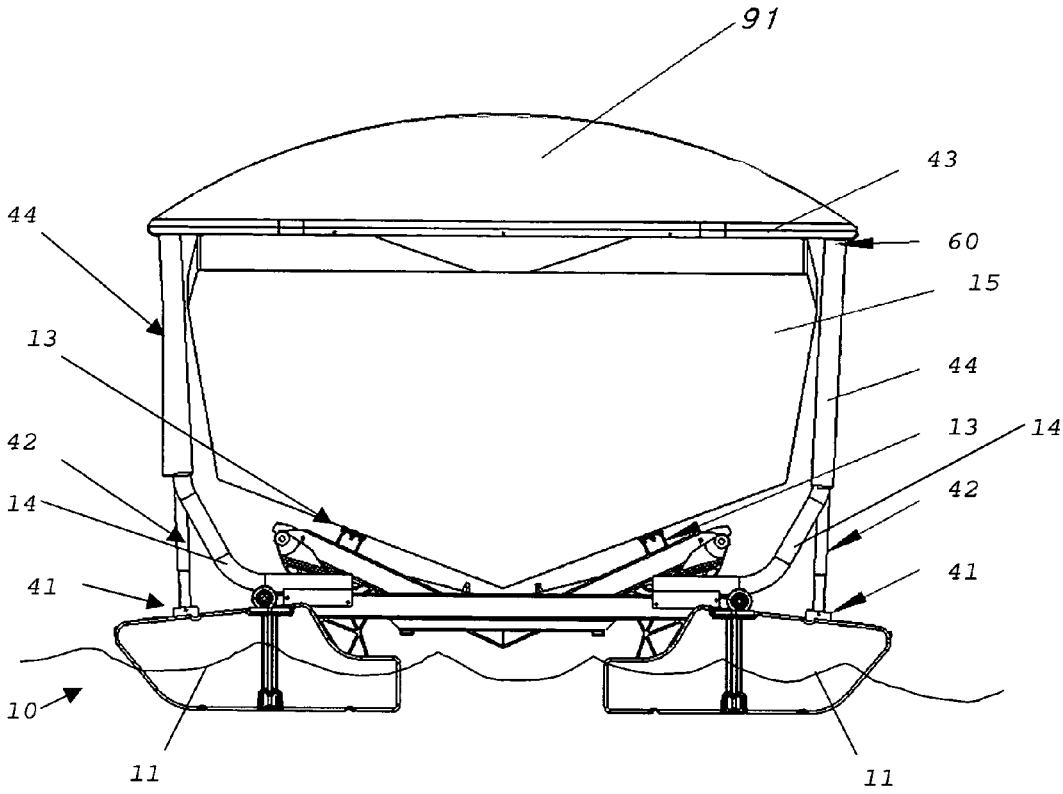
FIG. 11 is an end view of the present invention integrated to the prior art watercraft lift in the watercraft-up position.

FIG. 11 is an end view of the present invention integrated to the prior art watercraft lift 10 in the watercraft-up position. The base of the linkage 42 is attached to the control element 41 that is positioned vertically below the watercraft support bunks 13 at this point in the lift's operation. The linear distance from the base of the linkage 42 to the canopy frame 43 is determined by the length of the linkage 42 and is constant throughout the movement of the lift. The height of the canopy/cover 91 relative to the watercraft 15 is determined by the position of the watercraft support bunks 13 relative to the lower base of the linkage 42 that is attached to the approximate center of the floats 11 via the control element 41. The canopy support connection 44 is retracted into the upright members 14 of the prior art. The canopy/cover 91 is positioned such that the lower perimeter of the canopy/cover 91 is below or vertically parallel to the upper-most side structures of the subject watercraft 15. The upward bowing of the canopy/cover 91 caused by the rafters 81 allows space for the subject watercraft's windshield or other upwardly extending structures.

Figure 12:
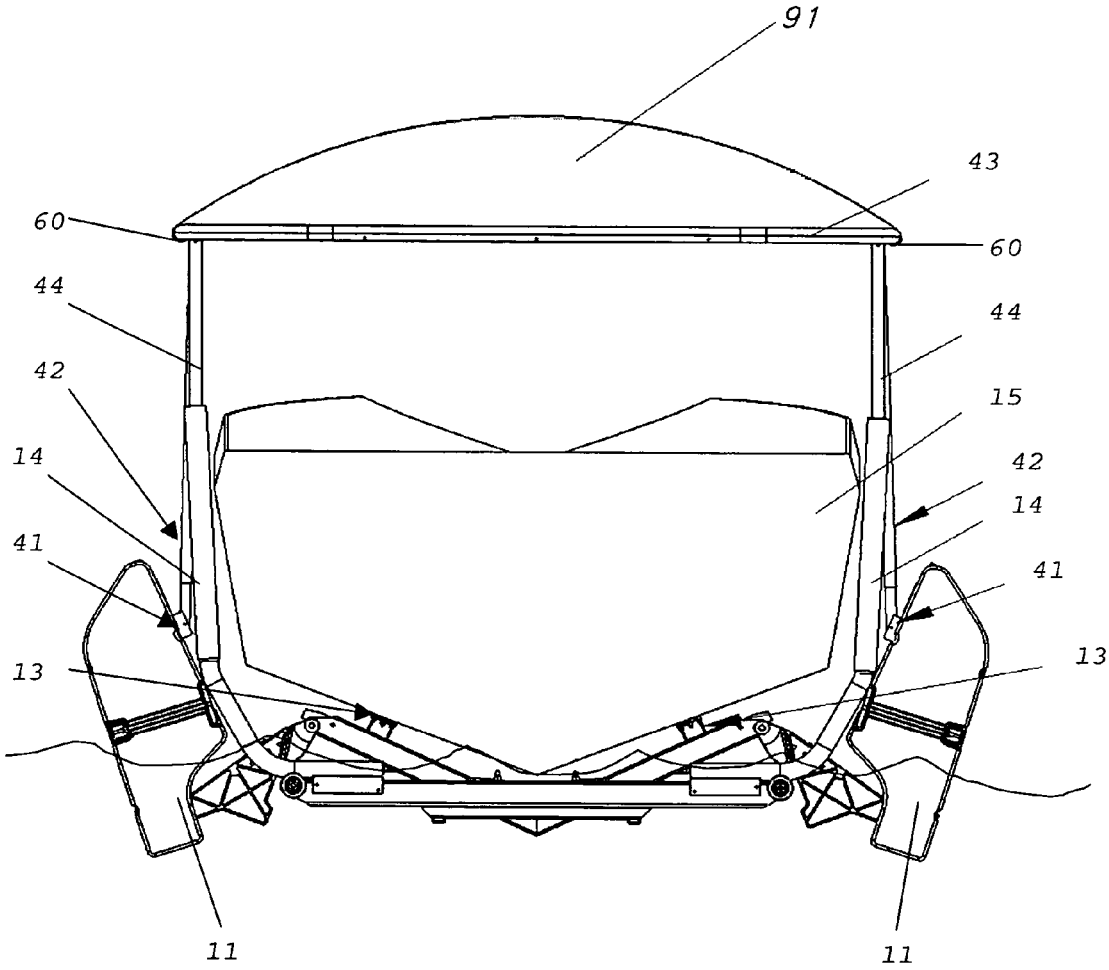
FIG. 12 is an end view of the present invention integrated to the prior art watercraft lift at the approximate mid-point between the watercraft-up position and watercraft-down position.

FIG. 12 is an end view of the present invention integrated to the prior art watercraft lift 10 at the approximate mid-point between the watercraft-up position and watercraft-down positions. The base of the linkage 42 remains attached to the control element 41 that is positioned approximately horizontal to the watercraft support bunks 13 at this point in the lift's operation. The linear distance from the base of linkage 42 to the canopy frame 43 is determined by the length of the linkage and is constant throughout the movement of the lift. The height of the canopy/cover 91 relative to the subject watercraft 15 is determined by the position of the watercraft support bunks 13 relative to the lower base of the linkage that is attached to the approximate center of the floats 11 via the control element 41—this distance being relatively greater than the corresponding distance described in FIG. 11 due to the vertical motion of the floats 11. The canopy support connection 44 is partially extended from the upright members 14 of the prior art. The canopy/cover 91 is positioned such that the lower perimeter of the canopy/cover 91 is vertically parallel to or above the upper-most side structures of the subject watercraft 15.

Figure 13:
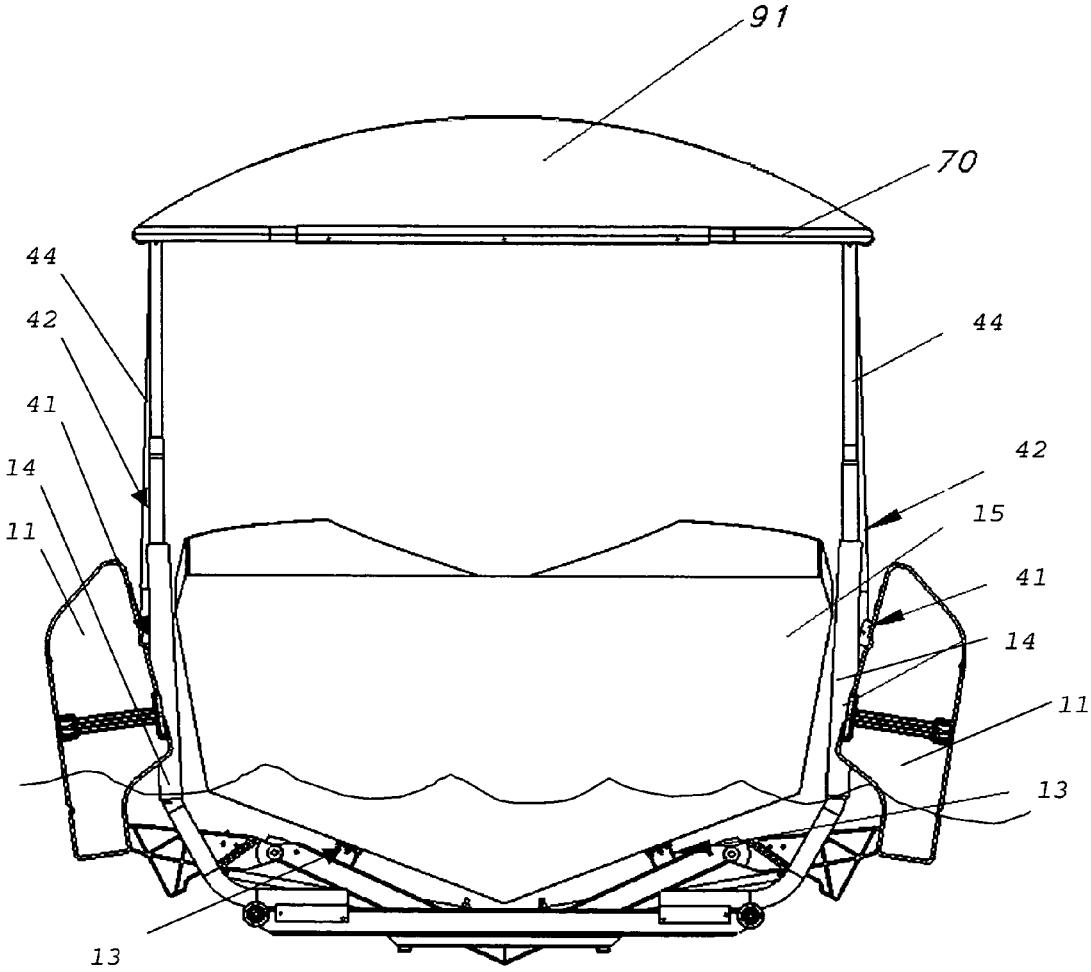
FIG. 13 is an end view of the present invention integrated to the prior art watercraft lift in the watercraft-down position.

FIG. 13 is an end view of the present invention integrated to the prior art watercraft lift in the watercraft-down position. The base of the linkage 42 remains attached to control element 41 that is positioned vertically above the watercraft support bunks 13 at this point in the lift's operation. The linear distance from the base of the linkage 42 to the canopy frame 43 is determined by the length of the linkage and is constant throughout the movement of the lift. The height of the canopy/cover 91 relative to the subject watercraft 15 is determined by the position of the watercraft support bunks 13 relative to the lower base of the linkage 42 that is attached to the approximate center of the floats 11 via the control element 41—this distance being relatively greater than the corresponding distance described in FIGS. 11 and 12 due to the upward vertical motion of the floats 11. The canopy support connection 44 is fully extended from the upright members 14 of the prior art. The canopy/cover 91 is positioned such that the lower perimeter of the canopy/cover 91 is above the upper-most side structures of the subject watercraft 15.

Figure 14:
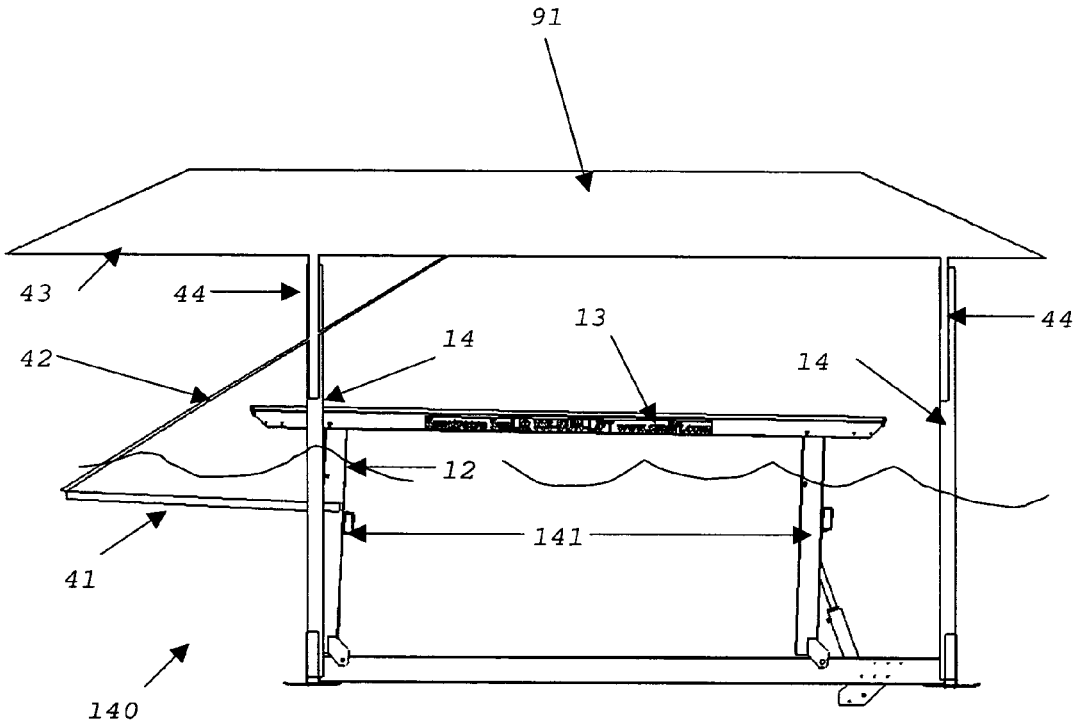
FIG. 14 is a side view of a second embodiment of the invention integrated to a prior art cantilever lift in the watercraft-up position.

FIG. 14 is a side view of a second embodiment of the present invention integrated to a prior art cantilever lift 140 in the watercraft-up position. The base of the linkage 42 is pivotally attached to control element 41, which in this embodiment is a rigid extrusion welded or otherwise attached to cantilevering aspects 141 of the prior art watercraft lift 140. The control element 41 is approximately parallel to the waterline in this watercraft-raised position. The linkage 42 is angled at approximately forty-five degrees relative to the waterline. The linear distance from the base of the linkage 42 to canopy frame 43 is determined by the length of the linkage 42 and is constant throughout the movement of the lift. The height of the canopy/cover 91 relative to the watercraft (not shown) is determined by the position of the watercraft support bunks 13 relative to the lower base of the linkage 42 that is attached to the cantilevering aspects of the lifting structure 12 via control element 41. The canopy support connection 44 is retracted into the upright members 14 of the prior art 140. The canopy/cover 91 is positioned such that the lower perimeter of the canopy/cover 91 is below or vertically parallel to the upper-most side structures of the subject watercraft (not shown). The upward bowing of the canopy/cover 91 allows space for the subject watercraft's windshield or other upwardly extending structures.

Figure 15:
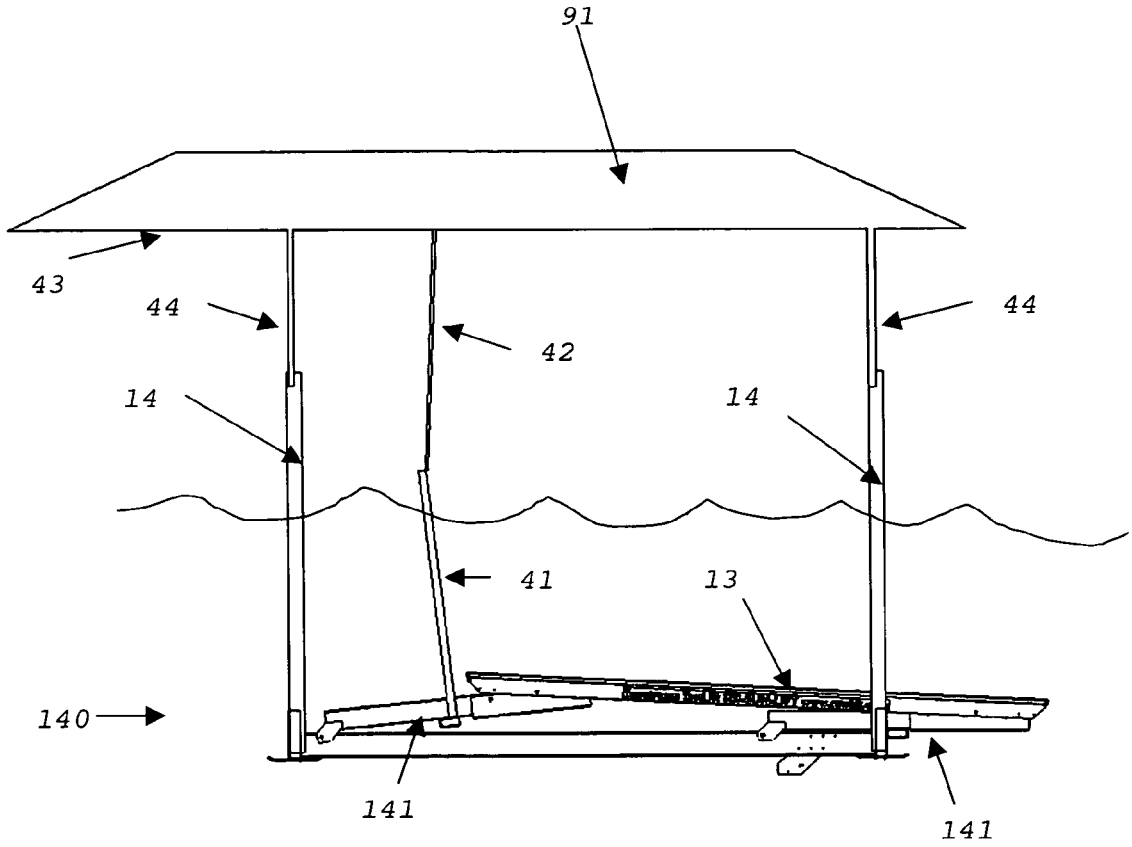
FIG. 15 is a side view of a second embodiment of the present invention integrated to a prior art cantilever lift in the watercraft-down position.

FIG. 15 is a side view of a second embodiment of the present invention integrated to a prior art cantilever lift 140 in the watercraft-down position. The base of the linkage 42 is pivotally attached to control element 41, which in this embodiment is a rigid extrusion welded or otherwise attached to cantilevering aspects 141 of the prior art watercraft lift 140. The control element 41 is approximately perpendicular to the waterline in this lowered position. The linkage 42 is angled at approximately ninety degrees relative to the waterline in this position. The linear distance from the base of the linkage 42 to canopy frame 43 is determined by the length of the linkage 42 and is constant throughout the movement of the lift. The height of the canopy/cover 91 relative to the watercraft (not shown) is determined by the position of the watercraft support bunks 13 relative to the lower base of the linkage 42 that is attached to the cantilevering aspects of the lifting structure 12. The canopy support connection 44 is slideably extended from the upright members 14 of the prior art 140. The canopy/cover 91 is positioned such that the lower perimeter of the canopy/cover 91 is above the upper-most side structures of the subject watercraft (not shown).

Figure 16:
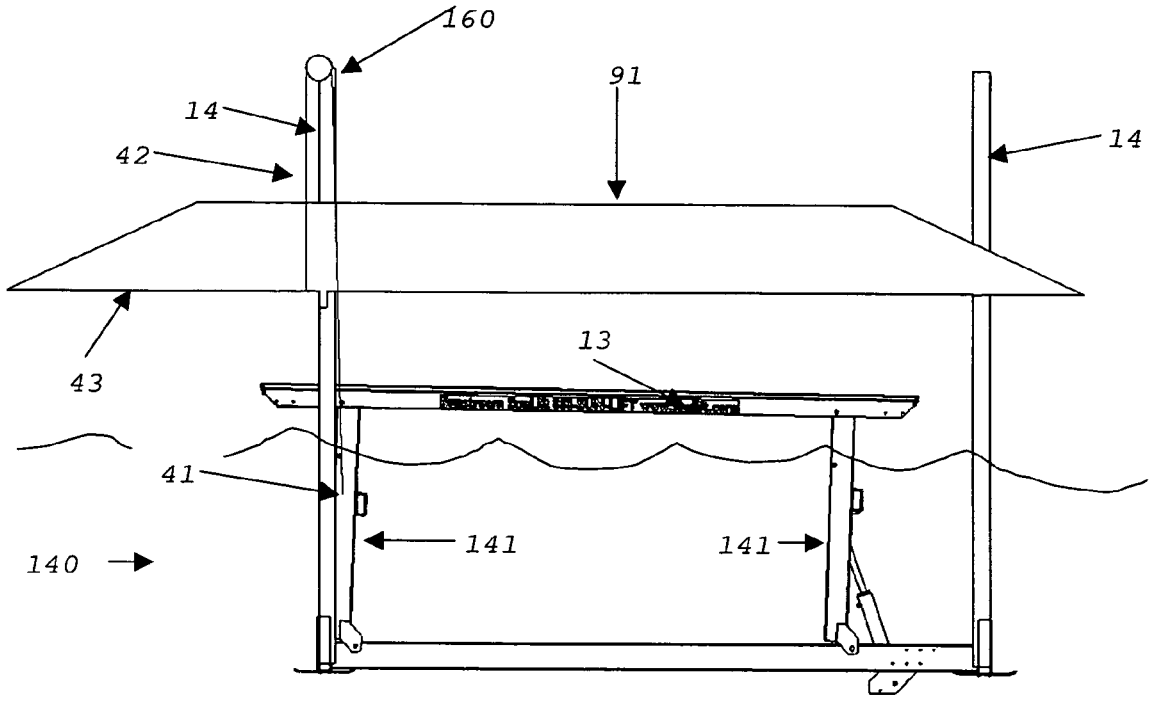
FIG. 16 is a side view of a third embodiment of the present invention integrated to a prior art cantilever lift in the watercraft-up position.

FIG. 16 is a side view of a third embodiment of the present invention integrated to a prior art cantilever lift 140 in the watercraft-up position. The base of the linkage 42, in this embodiment a non-rigid line consisting of cable, rope or some other flexible material, is attached to control element 41, which in this embodiment is a bolt or some other device to which the non-rigid line is connected to cantilevering aspects 141 of the prior art watercraft lift 140. The control element 41 is approximately parallel to the waterline in this watercraft-raised position. The linkage 42 is positioned to run through a pulley 160 that is attached at the top of upright members 14 which in this embodiment extend through the canopy frame 43 so that the canopy frame 43 and canopy/cover are vertically slideable along the vertical axis of said upright members 14. The height of the canopy/cover 91 relative to the watercraft (not shown) is determined by the position of the control element 41, the length of linkage 42, and the position of pulley 160. The canopy/cover 91 is positioned such that the lower perimeter of the canopy/cover 91 is below or horizontally parallel to the upper-most side structures of the subject watercraft (not shown). The upward bowing of the canopy/cover 91 allows space for the subject watercraft's windshield or other upwardly extending structures.

Figure 17:
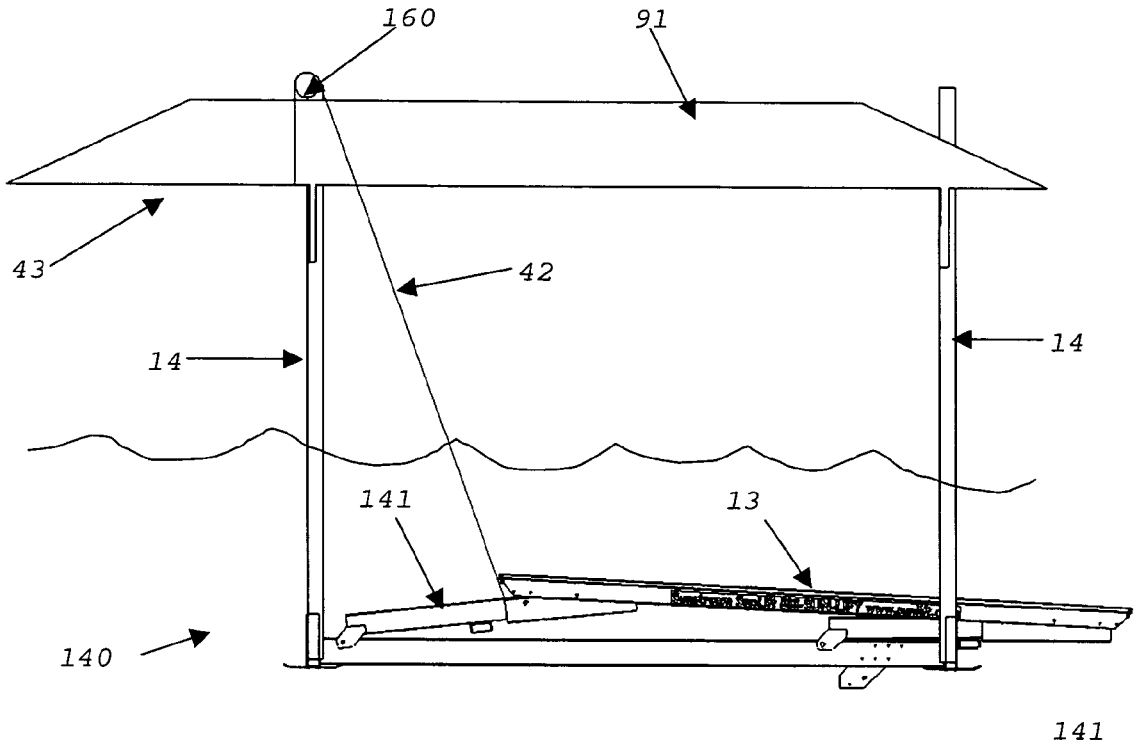
FIG. 17 is a side view of a third embodiment of the present invention integrated to a prior art cantilever lift in the watercraft-down position.

FIG. 17 is a side view of a third embodiment of the present invention integrated to a prior art cantilever lift 140 in the watercraft-down position. The base of the linkage 42, in this embodiment a non-rigid line consisting of cable, rope or some other flexible material, is attached to control element 41, which in this embodiment is a bolt or some other device to which the non-rigid line is connected to cantilevering aspects 141 of the prior art watercraft lift 140. The control element 41 is below the waterline in this watercraft-lowered position. The linkage 42 is positioned to run through a pulley 160 that is attached at the top of upright members 14 which in this embodiment extend through the canopy frame 43 so that the canopy frame 43 and canopy/cover 91 are vertically slideable along the vertical axis of said upright members 14. The height of the canopy/cover 91 relative to the watercraft (not shown) is determined by the position of the control element 41, the length of linkage 42, and the position of the pulley 160. In this watercraft-down position, the downward vertical motion of the cantilevering aspects of the lift 141 is translated to the linkage 42 through the control element 41, causing the linkage 42 to move through the pulley 160 and thereby raising the canopy/cover 91 relative to the bunks 13 and waterline. The canopy/cover 91 is positioned such that the lower perimeter of the canopy/cover 91 is above the upper-most side structures of the subject watercraft (not shown). It will be understood by one skilled in the art that this embodiment of the invention could also be used with a prior art floating watercraft lift such as an air-displacement lift.

Figure 18:
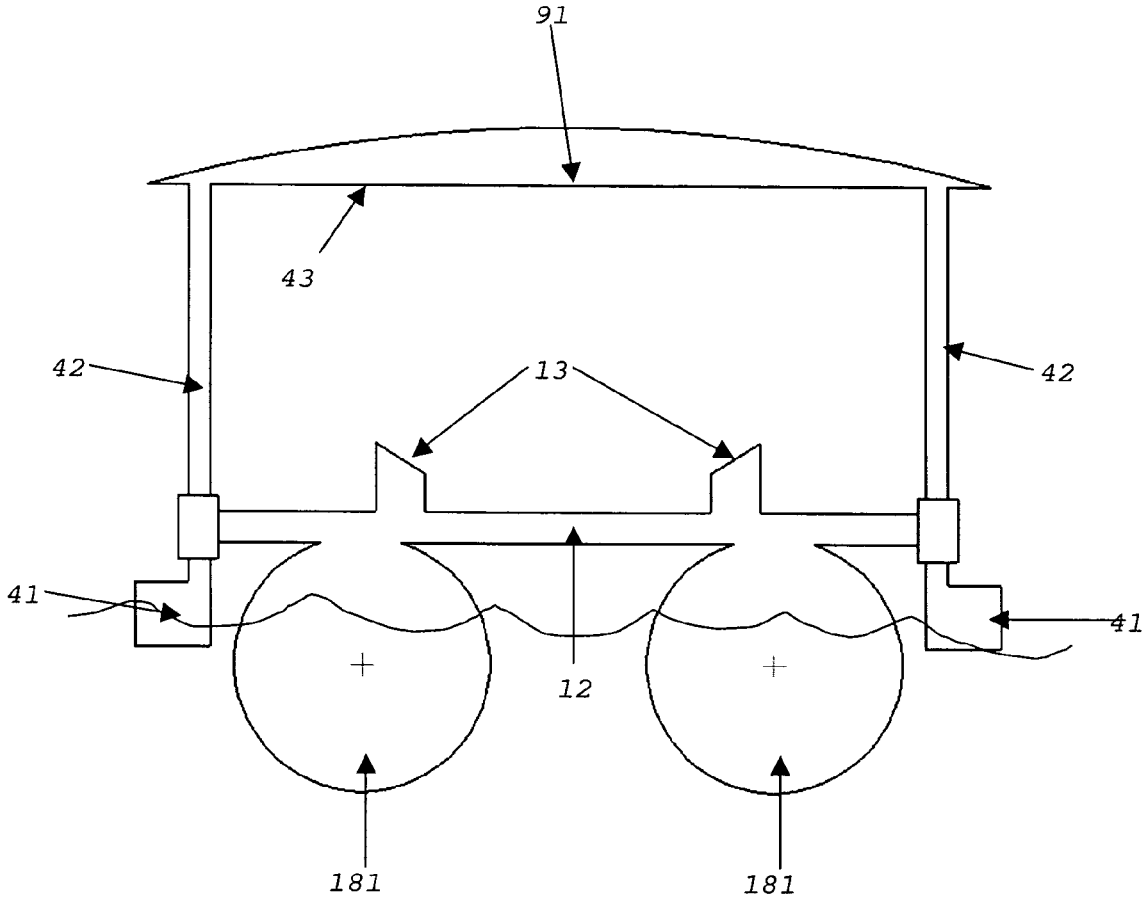
FIG. 18 is an end view of a fourth embodiment of the present invention integrated to a prior art floating, air-displacement lift in the watercraft-up position.

FIG. 18 is an end view of a fourth embodiment of the present invention integrated to a prior art floating, air-displacement lift 180 in the watercraft-up position. The base of the linkage 42 is attached to control element 41, which in this embodiment is a float with sufficient buoyancy in concert with other similarly attached control elements to independently support linkage 42 and canopy/cover 91. The linear distance from the base of the linkage 42 to canopy frame 43 is determined by the length of the linkage 42 and is constant throughout the movement of the lift. The height of the canopy/cover 91 relative to the watercraft (not shown) is determined by the position of the watercraft support bunks 13 relative to the lower base of the linkage 42 that is attached to the control element 41. The canopy support connection 44 (shown in FIG. 19), which is attached to the lifting structure 12, is retracted into linkage 42. The control element 41 contains a central hole that allows the canopy support connection 44 (shown in FIG. 19) to vertically translate through the control element 41 while being held horizontally in place by the rigidity of linkage 42. The lifting structure 12 is above the waterline due to the buoyancy of the air-displacement floats 181. The canopy/cover 91 is positioned such that the lower perimeter of the canopy/cover 91 is approximately parallel to or below the upper-most side structures of the subject watercraft (not shown).

Figure 19:
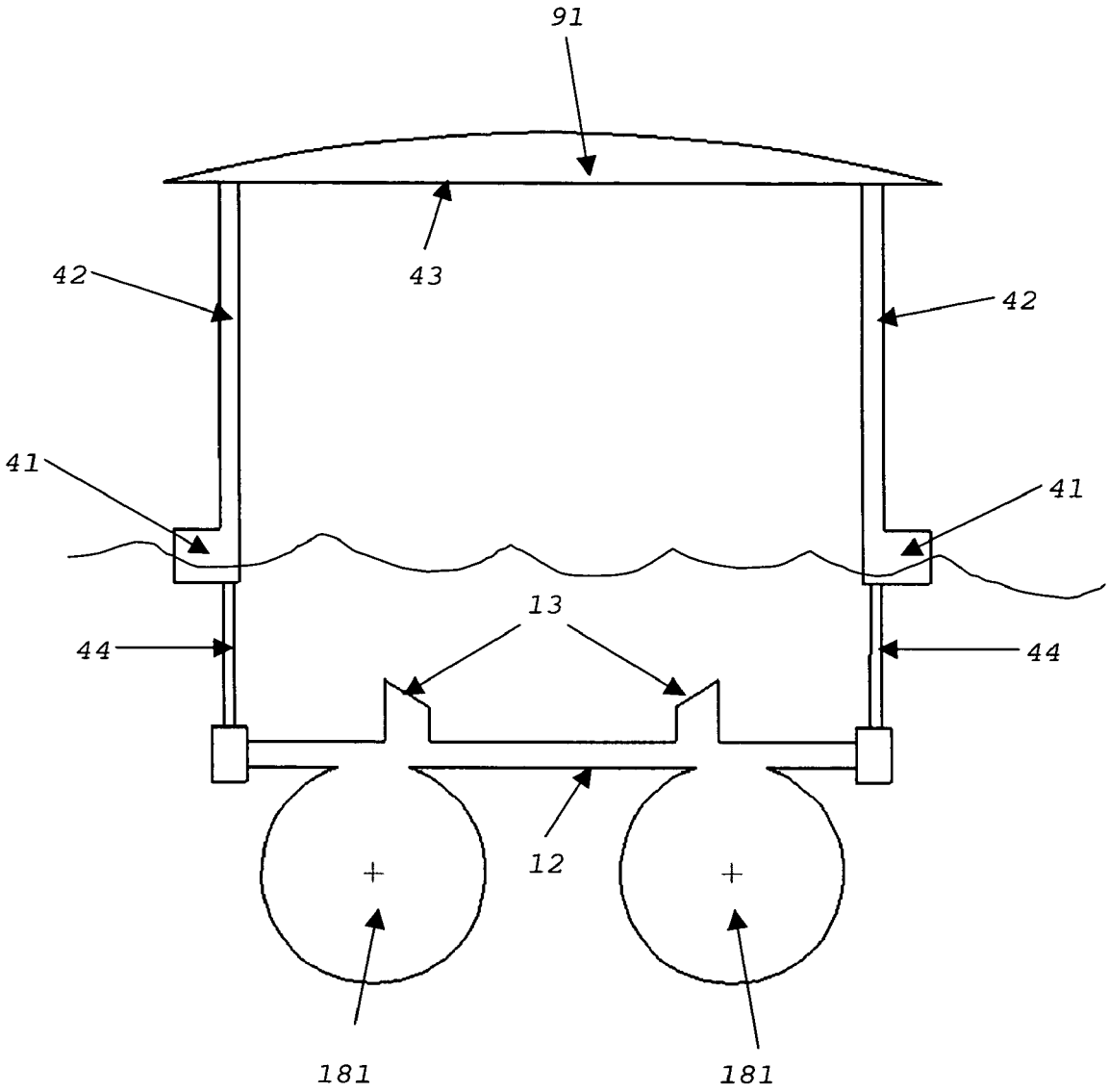
FIG. 19 is an end view of a fourth embodiment of the present invention integrated to a prior art floating, air-displacement lift in the watercraft-down position.

FIG. 19 is an end view of a fourth embodiment of the present invention integrated to a prior art floating, air-displacement lift 180 in the watercraft-down position. The base of the linkage 42 is attached to control element 41, which in this embodiment is a float with sufficient buoyancy in concert with other similarly attached control elements to independently support linkage 42 and canopy/cover 91. The linear distance from the base of the linkage 42 to canopy frame 43 is determined by the length of the linkage 42 and is constant throughout the movement of the lift. The height of the canopy/cover 91 relative to the watercraft (not shown) is determined by the position of the watercraft support bunks 13 relative to the lower base of the linkage 42 that is attached to the control element 41 floats. The canopy support connection 44, which is attached to the lifting structure 12, is extended downward from linkage 42. The lifting structure 12 is below the waterline due to the lack of buoyancy of the air-displacement floats 181. The canopy/cover 91 is positioned such that the lower perimeter of the canopy/cover 91 is above the upper-most side structures of the subject watercraft (not shown).

What is claimed is:

1. A self-adjusting watercraft canopy/cover for raising and lowering a watercraft in water, comprising:

a protective cover;

a lifting structure configured to receive and support the watercraft;

at least one float rotatably attached to the lifting structure and selectively rotatable with respect to the lifting structure between a first substantially vertical position in the water and a second substantially horizontal position in the water different from the first substantially vertical position, the rotatable float supporting the lifting structure and moving the lifting structure between a first elevational position and a second elevational position in response to rotation of the float between the first substantially vertical position and the second substantially horizontal position, respectively, wherein when the float is in the first substantially vertical position and the lifting structure is in the first elevational position the lifting structure is sufficiently submerged to receive and deploy the watercraft and when the float is in the second substantially horizontal position and the lifting structure is in the second elevational position the lifting structure is sufficiently raised to lift the watercraft substantially out of the water; and at least one linkage having upper and lower ends, the upper end functionally connected to the protective cover and the lower end functionally connected to the rotatable float such that when the float is moved from the second substantially horizontal position to the first substantially vertical position, the rotational movement of the float in the water is translated to the protective cover through the linkage to raise the protective cover to a first cover position, and when the rotatable float is moved from the first substantially vertical position to the second substantially horizontal position, the rotational movement of the float in the water is translated to the protective cover through the linkage to lower the protective cover to a second cover position closer to the lifting structure than when in the first cover position.

2. The canopy/cover according to claim 1 wherein the cover comprises a flexible, synthetic material.

3. The canopy/cover according to claim 1 wherein the linkage comprises a hollow telescoping inner linkage and hollow outer telescoping linkage, one of the inner and outer telescoping linkages including the lower end and the other of the inner and outer telescoping linkages including the upper end, the lower end being rotatably coupled to the rotatable float and moving therewith as the float rotates in the water and the upper end being coupled to the protective cover, the inner and outer telescoping linkages being telescopically extendible and retractable to adjustably select an overall length for the linkage and lockable relative to each other to maintain the selected overall length as the float rotates between the first substantially vertical position and the second substantially horizontal position to thereby permit selection of the closeness of the protective cover to the watercraft when supported on the lifting structure with the lifting structure in the second elevational position.

4. The canopy/cover according to claim 3 wherein the hollow telescoping inner linkage and hollow telescoping outer linkage are comprised of a rigid material.

5. The canopy/cover according to claim 3 wherein the hollow telescoping inner linkage and hollow telescoping outer linkage are comprised of plastic.

6. The canopy/cover according to claim 3 wherein the hollow telescoping inner linkage and hollow telescoping outer linkage are comprised of metal.

7. The canopy/cover according to claim 1 wherein the linkage is functionally connected to the rotatable float by a bracket.

8. The canopy/cover according to claim 1 wherein the rotational movement of the rotatable float between the first substantially vertical position and the second substantially horizontal position produces substantially vertical motion of the protective cover and substantially vertical motion of the lifting structure.

9. The canopy/cover according to claim 1 wherein the rotatable float has a first buoyancy when in the first substantially vertical position in the water and a second buoyancy when in the second substantially horizontal position in the water, the second buoyancy being greater than the first buoyancy.

10. A self-adjusting watercraft canopy/cover comprising:

a protective cover;

a lifting structure configured to receive and support the watercraft, the lifting structure being moveable between a first elevational position in which the lifting structure is sufficiently submerged to receive and deploy the watercraft and a second elevational position in which the lifting structure is sufficiently raised to lift the watercraft substantially out of the water;

at least one float rotatably attached to the lifting structure and adjustably rotatable with respect to the lifting structure between a first substantially vertical orientation in the water and a second substantially horizontal orientation in the water, the float having a first buoyancy when in the first substantially verical orientation in the water and a second buoyancy when in the second substantially horizontal orientation in the water, the second buoyancy being greater than the first buoyancy, the lifting structure moving from the first elevational position to the second elevational position in response to movement of the float in the water from the first substantially vertical orientation in the water to the second substantially horizontal orientation in the water, and the lifting structure moving from the second elevational position to the first elevational position in response to movement of the float in the water from the second substantially horizontal orientation in the water to the first substantially vertical orientation in the water; and at least one linkage having upper and lower ends, the upper end functionally connected to the protective cover and the lower end functionally connected to the float such that when the float is moved from the second substantially horizontal orientation in the water to the first substantially vertical orientation in the water, the movement of the float is translated to the protective cover through the linkage to raise the protective cover to a first cover position, and when the float is moved from the first substantially vertical orientation in the water to the second substantially horizontal orientation in the water, the movement of the float is translated to the protective cover through the linkage to lower the protective cover to a second cover position closer to the watercraft than when in the first cover position.

11. A self-adjusting watercraft canopy/cover for raising and lowering a watercraft in water, comprising:

a protective cover;

a lift including at least one float and a lifting structure supported by the float, the float being rotatably attached to the lifting structure, the lifting structure configured to receive and support the watercraft, in response to selective rotation of the float in the water the lifting structure being moveable between a first elevational position in which the lifting structure is sufficiently submerged to receive and deploy the watercraft and a second elevational position in which the lifting structure is sufficiently raised to lift the watercraft substantially out of the water, the float while supporting the lifting structure being rotatable with respect to the lifting structure between a first angular orientation with the float having a first buoyancy and a second angular orientation with the float having a second buoyancy, the first angular orientation being substantially transverse to the second angular orientation, the second buoyancy being greater than the first buoyancy, the lifting structure moving between the first elevational position and the second elevational position in response to selective rotation of the float in the water from the first angular orientation to the second angular orientation , and the lifting structure moving between the second elevational position and the first elevational position in response to selective rotation of the float in the water from the second angular orientation to the first angular orientation; and at least one linkage having upper and lower ends, the upper end functionally connected to the protective cover and the lower end functionally connected to the float to translate rotation of the float to the protective cover through the linkage to move the protective cover between a first cover position at a first distance above the lifting structure and a second cover position at a second distance above the lifting cover, the first distance being greater than the second distance, such that when the lifting structure is moved from the first elevational position to the second elevational position the protective cover is moved toward the lifting structure from the first cover position to the second cover position and when the lifting structure is moved from the second elevational position to the first elevational position the protective cover is moved away from the lifting structure from the second cover position to the first cover position.

* * * * *